United States Patent [19]

Jamison, Jr.

[11] 4,170,188

[45] Oct. 9, 1979

[54] AQUATIC DEVICE ATTACHABLE TO A TWO-WHEELED VEHICLE

[76] Inventor: Joseph L. Jamison, Jr., P.O. Box 607, Arlington, Va. 22216

[21] Appl. No.: 808,798

[22] Filed: Jun. 22, 1977

[51] Int. Cl.[2] ..... B63H 16/12

[52] U.S. Cl. ..... 115/27; 115/2; 115/26

[58] Field of Search ..... 115/27, 26, 25, 22, 115/21, 2

[56] References Cited

U.S. PATENT DOCUMENTS

| | | | |
|---|---|---|---|
| 535,623 | 3/1895 | Klein | 115/27 |
| 577,269 | 2/1897 | Powley | 115/26 |
| 621,465 | 3/1899 | Storms | 115/27 |
| 643,678 | 2/1900 | Perry | 115/27 |
| 799,667 | 9/1905 | Payette | 115/02 |
| 3,640,239 | 2/1972 | Petroskey | 115/27 |

*Primary Examiner*—Barry L. Kelmachter
*Assistant Examiner*—Sherman D. Basinger

[57] ABSTRACT

The invention to be described is an aquatic apparatus of at least one hull which is readily attachable and detachable from its propulsive member—the propulsive member being a tandem-wheeled vehicle such as a bicycle or motorcycle which is prepared for attachment by having its wheels removed.

6 Claims, 21 Drawing Figures

FIG. III
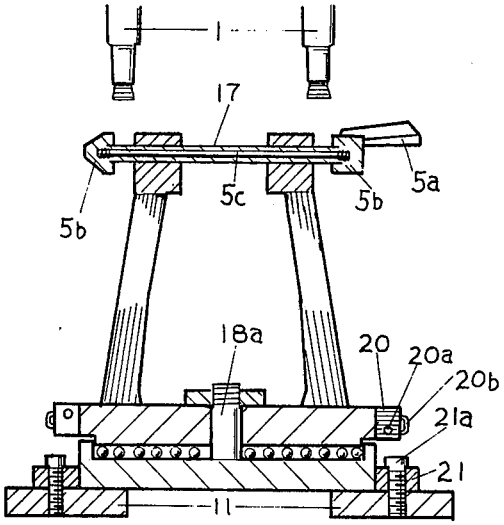
FIG. IV
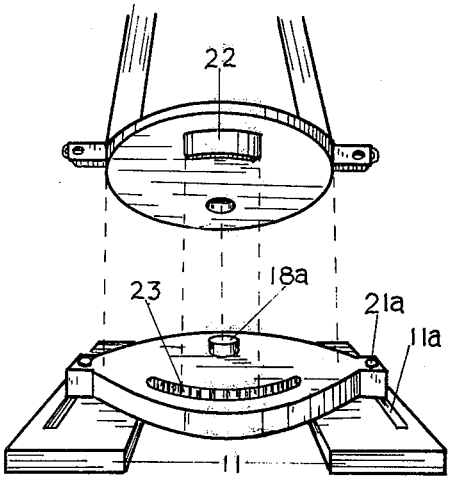
FIG. V
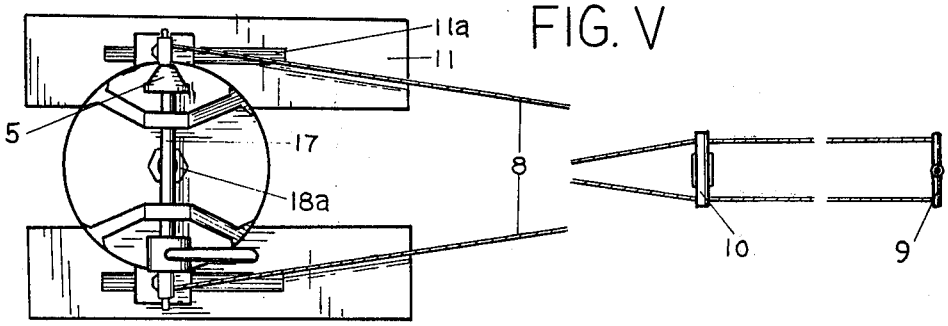
FIG. VI
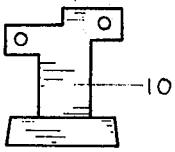
FIG. VII
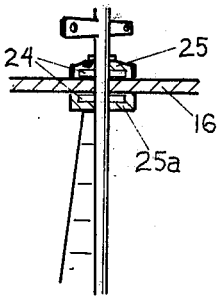

FIG. VIII
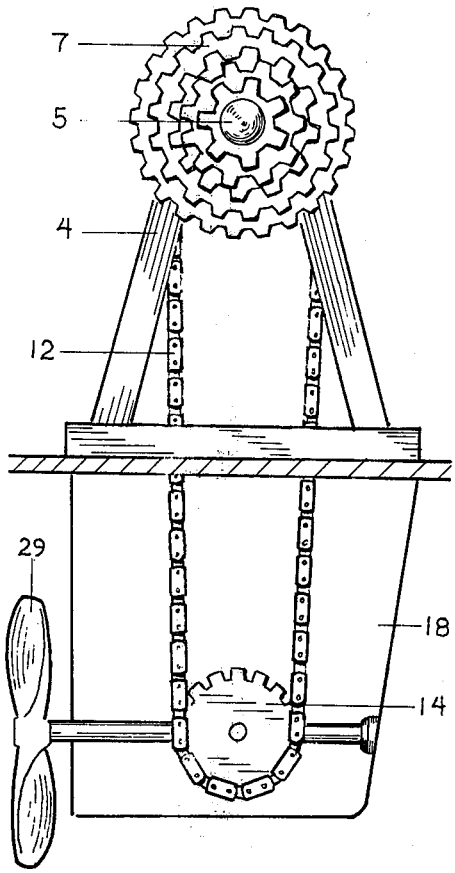
FIG. IX
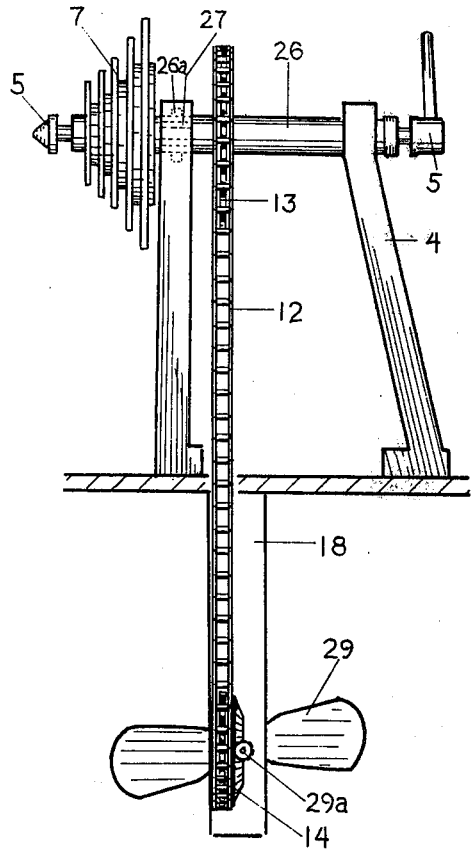
FIG. X
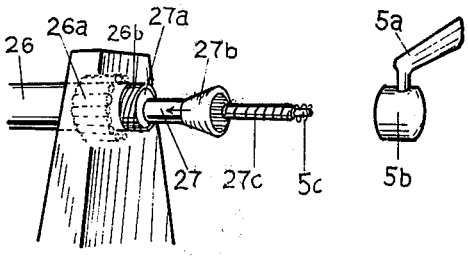
FIG. XI
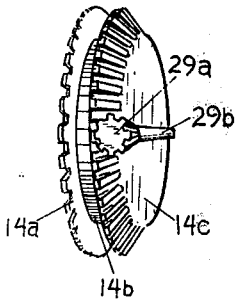

FIG. XIIa
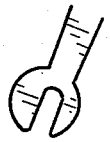
FIG. XIIb
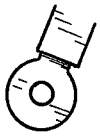
FIG. XIIc
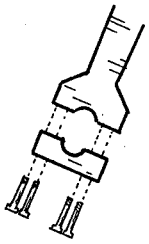
FIG. XIII
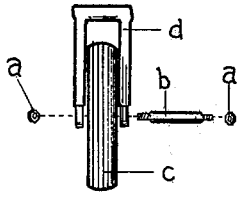
FIG. XIVa
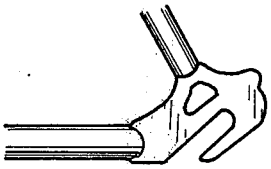
FIG. XIVb
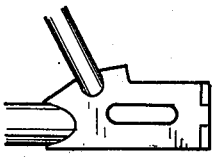
FIG. XIVc
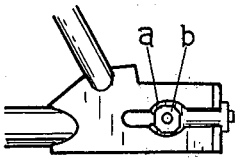
FIG. XV
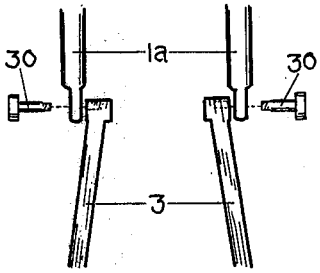
FIG. XVI
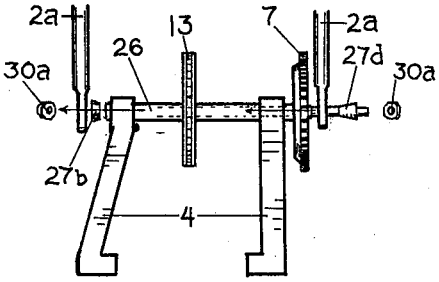
FIG. XVII
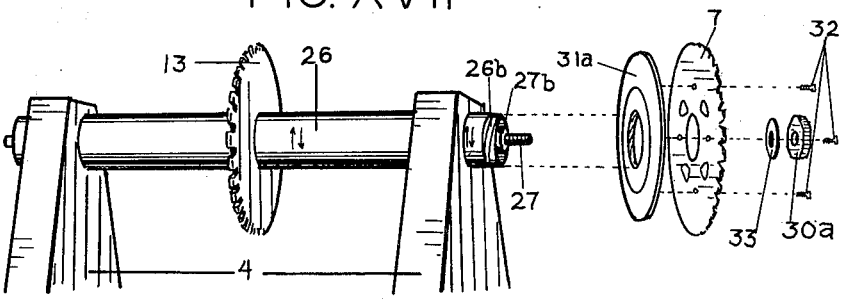

AQUATIC DEVICE ATTACHABLE TO A TWO-WHEELED VEHICLE

SUMMARY OF THE INVENTION

Two-wheeled devices adapted to boats or boats adapted to two-wheeled devices are nothing new. What is generally lacking, however, are designs which are not unwieldy, overly-complicated, impractical, or even unseaworthy.

Highly representative examples of the prior art are the inventions depicted in U.S. Pat. Nos. 547,422; 577,269; 2,304,430; 3,640,239; and 3,982,495. As can be seen in these exemplifications, the suggested device basically consists of a whole bicycle mounted on a boat which is modified (and often with great complexity) to accommodate a whole bicycle. The mechanism which conducts the motive activities of the bicycle through to the propeller is in most cases either a drum or roller which is pressed up against the rear tire of the bicycle, therefore rotating when the tire revolves and transfering this rotation to the propeller. It may also be a redirected drive chain which is removed from the rear sprocket of the wheel of the vehicle and repositioned onto a sprocket mounted on the hull which in turn drives the propeller.

The disadvantages of the first system are as follows:

1. The roller mechanism is cumbersome and unreliable—unreliable in the sense of diminished efficiency when or if the tire becomes wet or if, through vibration, the tire becomes slightly disengaged from the roller.

2. The use of such a system necessitates positioning the rear tire off the platform of the hull to enable the rear tire to spin freely, contacted only by the roller. Such a requirement places the bicycle well off the surface of the water and therefore places the rider very well off the surface of the water. This shifts the center of gravity of the apparatus well upward and, because of the unwieldiness of this condition, a wide-based and substantial hull structure coupled with the need to support the vehicle with long, clumsy, and unaesthetic guy lines or braces is demanded. Such a positioning of the vehicle also makes the aquatic device more difficult to mount.

The disadvantages of the second system are as follows:

1. As the frame sizes of bicycles are not standardized and as the diameters of front and rear sprockets are not standardized and as there are bicycles with front and rear derailleurs to consume their unique allotments of chain, chain lengths are not standardized. Therefore, unless one were unusually fortunate, one would have to shorten or lengthen one's chain as a prerequisite to affixing the chain around the hull-mounted sprocket, and reverse the procedure when land-use of the vehicle is again desired. As is apparent to anyone familiar with bicycles, disconnecting, shortening and lengthening, or even putting one's hands on the chain is a disagreeable and time-consuming experience.

2. Manipulation of the chain would require manipulation or perhaps removal of the front derailleur on ten or fifteen speed bicycles.

There are other drive mechanisms reported but all involve a not insignificant and, thus, potentially troublesome alteration of the basic format of the two-wheeled, chain-powered, customarily-land-associated device.

My invention does not.

There are three features of several that are indigenous to practically all bicycles, motorized bicycles ("mopeds"), "mini-bikes," and motorcycles which are of prime consideration to the invention:

1. The two wheels are mounted on two fork end brackets which are the extremities of the frame.

2. The two-wheeled device is powered by a continuous chain which encircles a sprocket connected in one way or another to the rear hub.

3. These vehicles are steered by handlebars which manipulate rotation of the front fork which in turn, of course, rotates the wheel.

And a further similarity:

As tires do sometimes need to be repaired or replaced, nearly all modern two-wheeled vehicles have very simplified methods for disengaging the wheels from the body of the vehicle.

The invention follows naturally from these considerations.

Unless the aforedescribed roller mechanism is utilized, the wheels are unnecessary. The bicycle, moped, mini-bike, or motorcycle can be supported on its front and rear forks with substantial stability should properly designed support assemblies be utilized. This brings the center of gravity down and, provided the support structures are robust enough, eliminates the need for additional vehicle stabilizing attachments.

The bicycle (or whatever) is now resting on its forks. The rear wheel and, therefore, hub and rear sprocket are gone. The chain remains and can easily be fixed without any alteration to a sprocket which is similar in design and identical in position to that which was on the rear wheel. All that is necessary to accomplish this is to make the rear mounting and support structure similar in layout to the rear wheel hub and sprocket assembly. Let it have a rotatable member—a hub—mounted on two braces; let the chain encircle a sprocket mechanism affixed to the outside of the hub like the sprocket mechanism on the relinquished wheel. Towards the middle of this now power-rotated hub, let another sprocket be affixed, encircled by another chain leading to a bevel gear which transfers power to a propeller. Let the front fork be clamped to a rotatable support member which, using two lines connected on opposite sides of this member, manipulates the rudder.

Do all this and you would have a land vehicle completely prepared for aquatic use in a few minutes.

The invention comprises the following improvements or novelties:

1. The two-wheeled motive device is quickly and easily attachable and detachable.

2. The aquatic component (the invention) demands no alteration in the configuration of the motive device except for the removal of the wheels.

3. The unique, though simple, mounting arrangement allows for a more stable and uncluttered design.

4. The steering and power transfer mechanisms are direct and simple.

5. The combination of (2), (3), and (4) allow for an overall less complicated and, therefore, lighter and possibly less expensive design.

BRIEF DESCRIPTION OF THE DRAWINGS

FIG. I is a non-detailed depiction of the invention with a two-wheeled motive vehicle (bicycle) mounted in position;

FIG. II is a top view of the invention illustrating the general layout of steering and power components and one possible hull configuration;

Figure 1:
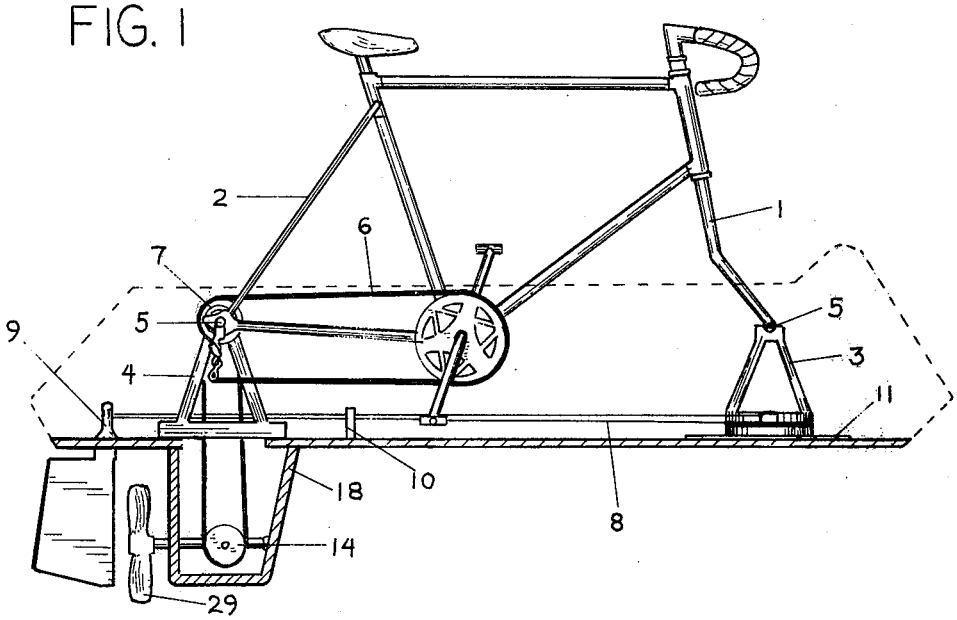
Figure 11:
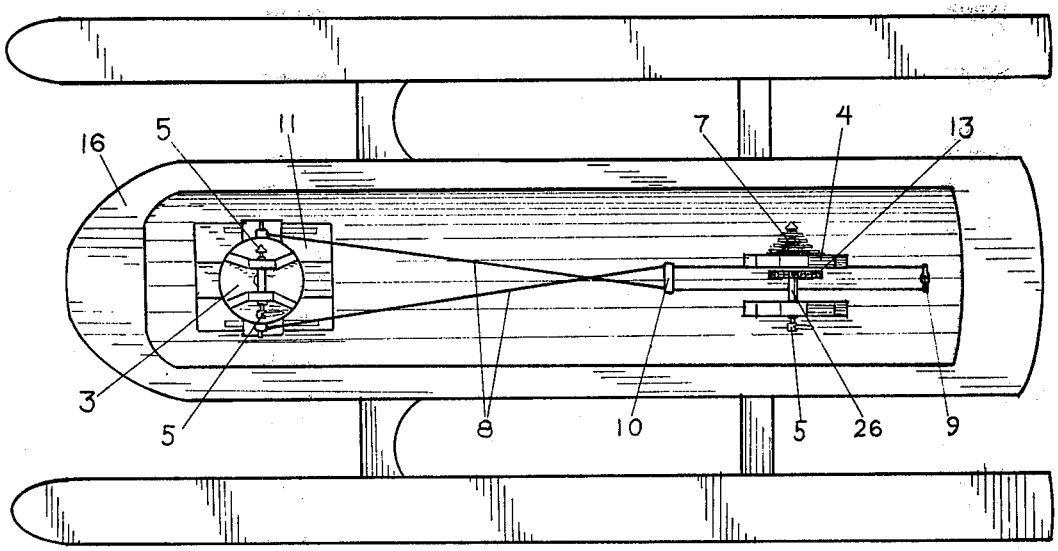

FIG. III is a cross-section of the front fork housing and steerage swivel assembly;

FIG. IV is an alternative design of the assembly of FIG. III;

FIG. V is a top view of the steerage components;

FIG. VI is a detailed front view of one steerage component;

FIG. VII is a detailed front view of another steerage component;

FIG. VIII is a side view of the rear fork housing and drive assembly;

FIG. IX is a front view of the rear fork housing and drive assembly;

FIG. X is a detailed view of the hub and axle assembly;

FIG. XI is a detailed view of the propeller drive shaft and bevel gear drive mechanism;

FIGS. XIIa–c are depictions of the alternatives for front fork end bracket design;

FIG. XIII is a non-detailed depiction of the basic front fork-wheel-axle configuration of a motorcycle;

FIGS. XIVa–c are depictions of the two alternatives for rear fork end bracket design plus the assembled rear fork end unit for a motorcycle or motorized bicycle;

FIG. XV illustrates the adaptation of the invention's front fork housing to a two-wheeled vehicle with a closed front fork end bracket;

FIG. XVI is an illustration of the adaptation of the invention's rear fork housing to a two-wheeled motive vehicle having a closed rear fork end bracket; and FIG. XVII is an exploded view of the arrangement of the components of the rear drive hub and axle assembly for adaptation to a motorcycle or motorized bicycle.

DETAILED DESCRIPTION OF THE INVENTION

FIG. I outlines the position or attachment of the two-wheeled motive vehicle to the invention. Of note is the fact that the only alteration of the motive vehicle is the removal of its wheels. The motive vehicle in this figure is a bicycle though it could also be represented by a motorcycle, mini-bike, or moped wth only slight alteration of the design of the invention as will be explained later.

The motive vehicle is clamped securely to the invention via its front and rear fork end brackets 1 and 2 by the front fork housing and steerage swivel 3 and the rear fork housing and drive assembly 4 respectively. To hold fast the fork end brackets, a quick-release mechanism 5, well-known to bicycle hub construction, is employed. The details of its construction are shown in FIG. III and will be explained later. Advantages of this mounting arrangement are the ease at which the vehicle is prepared for its attachment onto the invention and the steadiness thereupon provided for the vehicle. Wheels are easily removed from all two-wheeled vehicles—particularly bicycles which often employ their own quick-release hub mechanism for their wheels—and only the weight of the vehicle would dictate the degree of difficulty for mounting the vehicle onto the invention. The procedure for mounting the vehicle would, therefore, be simply to place front and rear fork end brackets onto the fork housings, clamping the quick release mechanisms 5 and then positioning the motive vehicle drive chain 6 over rear drive sprocket 7. Steerage control lines are attached to opposite sides of the upper half of the front fork housing—the upper half is made to swivel on the bottom half and, thus, by affecting movement of the handlebars, one affects steerage of the boat by way of the connection of steerage lines 8 to rudder assembly 9. Through consideration of FIG. II, one notices that the lines cross and are supported and directed by the steerage line support cleat 10. The steerage lines cross to maintain the left turn of the wheel, left turn of the boat/right turn of the wheel, right turn of the boat condition. The steerage lines 8 are also at different heights to avoid interference. They cross where indicated to avoid conflict with the motion of the pedals should the motive vehicle be a bicycle or moped. The front fork housing and steerage swivel 3 is slidably mounted on an adjusting track 11. This is to enable its position to be adjusted to align with the separation between front and rear fork end brackets 1 and 2, this distance varying from vehicle to vehicle. The length of the steerage lines 8 is also easily adjusted and will be explained later in conjunction with a more detailed figure.

Apparent also in FIG. I is another drive chain, the propeller drive chain 12, extending from the hub drive sprocket 13 (as seen in FIG. II) through to and around the propeller drive sprocket and bevel gear assembly 14. The hub drive sprocket 13 is affixed to the drive hub 26 (FIG. II) which is rotatable and driven by the rear drive sprocket 7 which, in turn, is driven by the motive vehicle drive chain 6. As noted in the summary, a drive chain positioned around a rear drive sprocket is a characteristic common to every two-wheeled motive vehicle (with the rare exception of those vehicles which employ a drive shaft to power the rear wheel). If a reasonable duplication of the rear sprocket assembly as connected with the rear wheel hub of the motive vehicle can be affected with the rear fork housing and drive assembly 4 of the invention, connecting and subsequently powering the invention becomes no more complicated than reinstalling a wheel. The length of the motive vehicle drive chain does not have to be adjusted and the integrity, purpose, and function of the transmission or gearing system of the motive vehicle remains intact. As the rear sprocket assembly of all such vehicles is actually very simple, duplication of the assembly is likewise simple.

Regarding the hull design of the invention:

The dotted line as seen in FIG. I denotes the outline of the splash shell 16. The recommended design of the boat is as seen in FIG. II—a catamaran-type craft with the center section suspended slightly above the surface of the water with the propeller 29, the blade of rudder assembly shaft 9 and the propeller fairing 18 submerged. This arrangement is a highly stable one and reduces drag on the water. It also enables the largest component of the design—the mounting locale of the motive vehicle—to be made of non-seaworthy and, therefore, less durable and much lighter weight materials—weight being of major importance particularly in the instance where human legs will be supplying the power. The purpose of the splash shell becomes merely the means for keeping driver and motive vehicle dry.

The suggested catamaran configuration does not mean to preclude other hull designs such as a single or triple-hulled or even a hydroplane type. For the bicycle, moped, and low-powered motorcycle, the catamaran style would seem to present the optimum. A high-powered motorcycle, however, should provide adequate power to drive a hydroplane design with acceptable success.

FIGS. III, IV, V, VI, and VII are detailed views of the front fork housing and steerage components. Of particular note in FIG. III is the position of insertion of front fork end bracket 1 onto the front fork housing and the details of the quick release retainer mechanism 5. By a simple flick of lever 5a the two retainer knobs 5b move toward each other thereby tightening down on the front fork end bracket 1 which would be positioned in the space on the front fork housing shaft 17 between the retainer knobs and the struts of the front fork housing. The shaft 17 is non-rotating and its only purpose is housing the quick release axle 5c which traverses the inside of the shaft 17 from one retainer knob to the other. Regarding FIG. III in general, it is seen that, in construction, the front fork housing and swivel assembly is merely a simple swivel mechanism of a well-known type with a vertical axle 18a connecting top and bottom swivel components and a bearing ring 19 providing for non-constricted rotation of the top component. Two steering line processes 20 with apertures 20a provide connection of the unit with steerage lines 8. The steerage lines are inserted through apertures 20a and are tied around line loops 20b—adjusting line length, therefore, is a very simple procedure of untying and retying. Base processes 21 coupled with lock-down bolts 21a through slot 11a of adjusting track 11 provide for forwards or backwards displacement of the entire front fork housing and steerage assembly for the aforementioned purpose of fitting the two fork housings to the span of the frame of the two-wheeled motive vehicle.

To compensate for the forward rake of the front fork end bracket 1, the swivel could be canted sternwards or the alternate assembly as proposed in FIG. IV could be utilized, providing eccentric rotation around its vertical axle 18a—the movement stabilized by a retaining lip 22 in a bearinged slot 23.

FIG. V is a top view of the steerage system displaying the connection of the lines to the front fork housing and steerage assembly and their subsequent passage through the steerage line support cleat 10 and on through to stern connection at the rudder assembly shaft 9.

FIGS. VI and VII are front detailed views of the steerage line support cleat 10 and rudder assembly shaft 9. The function of the support cleat is to position the crossing of the lines 8 in a location of non-interference with the motive vehicle and maintain the one-line-above-the-other attitude of the steerage lines. The rudder assembly is of a simple and commonly used type with the rotation of the rudder assembly shaft facilitated by bearings 24 in rudder retainer housings 25 and 25a.

FIGS. VIII and IX are detailed side and front views of the rear fork housing and drive assembly 4. The rear drive sprocket 7 in this instance is the five-sprocket cluster indigenous to five and ten-speed bicycles although the invention is not limited to encorporating only the the multi-geared bicycle sprocket. Any sprocket type will work in harmony with the basic design of the invention—its exact form not dictated by the invention but, rather, the two-wheeled vehicle to be applied to the invention. This is a main feature of the invention. The layout of all two-wheeled motive vehicles is basically the same for all such vehicles—human or motor-powered. A continuous chain from the power source around a rear sprocket drives a rear hub. For use on land, the rear hub motivates a wheel with a tire. For use on water, my invention proposes motivation of another chain sprocket encircled by another chain connected to a propeller. The flexibility of the invention's design to accept any sprocket design with only minor alternation is due, therefore, to the commonality of design between bicycles, motorcycles, mini-bikes, and mopeds. The user of the invention needs only to affix a rear drive sprocket similar or identical to that which is already in use on his vehicle to the hub of the invention—hub diameters are standard in the industry and, of course, the hub diameter of my invention would equal those standards. With an identical sprocket, therefore, the user need make no adjustment to his vehicle to make it suitable for powering the invention and all the advantages of the multi-gearing intrinsic to the motive vehicle are retained. In conclusion, it may be said that the rear fork end housing and drive assembly is derivative of the rear drive assembly of the motive vehicle when prepared for normal land operation.

Regarding FIGS. VIII and IX in unison, rear drive sprocket 7 is affixed to rear drive hub 26 which is rotatable through the supports of the rear fork end housing. A hub bearing ring 26a is implanted in this housing and its placement is indicated by dotted outline in FIG. IX. Also indicated by dotted line is the rear axle 27 which traverses the interior of the hub. Traversing its interior is the axle 5c of the quick release retainer assembly 5.

The detail of this construction is illustrated by FIG. X. The rear drive hub 26 rotates through hub bearing ring 26a in rear-fork end housing 4. The rear drive sprocket 7 is affixed to this rotating hub via its threaded end indicated by 26b. Rear axle 27 maintains its autonomy from the rear hub through the axle bearing 27a. Two bearing retainer cups 27b are threaded onto each end of rear axle 27 and support the axle on the bearings. Quick release axle 5c traverses the interior of the rear axle 27 to be capped with knobs 5b on either end. The rear fork end bracket 2 is positioned onto the threaded portion 27c of rear axle 27 and is clamped down by the quick release mechanism 5. The rear axle 27 and rear fork end bracket 2 are, therefore, mutually held stationary while the rear drive hub 26, driven by the rear drive sprocket 7 powered by the motive vehicle drive chain 6, rotates.

The hub drive sprocket 13 is affixed to the rear drive hub 26, also, and motivates the propeller drive chain 12 which, in turn, rotates the propeller drive sprocket and bevel gear assembly 14. This gear assembly, in its turn, activates the propeller drive shaft bevel gear 29a. The detail of this assembly is shown in FIG. XI. The components of the propeller drive sprocket and bevel gear assembly 14 are a chain sprocket 14a affixed to a spacer 14b affixed to a bevel gear 14c. The propeller drive shaft bevel gear 29a is affixed to the propeller drive shaft 29b which is, quite expectedly, affixed to the propeller 29. The backward pull exerted by the water on the propeller is transferred to the propeller shaft and propeller bevel gear thus inspiring the particular configuration of the bevel gear arrangement illustrated; the two are forced into tight contact therefore avoiding problems of diminished contact resulting from thermal expansion of gear and shaft materials, turbulence of the system, and gear wear.

Adaptations of the Invention for Use with a Motor-Powered Vehicle

The basic design of the invention is suitable for use by all currently-existing tandem-two-wheeled motive vehicles, although slight differences in the fork end—hub assemblies do exist and are compensated for by slight alteration of the invention.

The inventor has not intended to imply that the possession of one version of the invention enables the user to utilize any type of two-wheeled vehicle with the invention. Differences do exist in such vehicles and must be accommodated for by different versions of the invention. The aquatic craft required by a motorcycle must be more robust in every way to that which would be fitted to a bicycle.

There is also variance in fork end bracket design as illustrated in FIGS. XIIa–c and FIGS. XIVa–c. FIG. XIIa is the open-ended bracket design common to all bicycles, most mopeds and mini-bikes, and some lighter-weight motorcycles. For such a design, no alteration to the aforementioned design of the invention is necessary.

The same is true for the fork end design of FIG. XIIc, a type common to many motorcycles. What is implied by these designs is that the front axle is retained by the front wheel when the wheel is slipped off the fork end bracket.

In contrast to such an arrangement is that necessitated by the design of FIG. XIIb. This closed-end bracket type is utilized by many motorcycles and requires removal of the front axle as a prerequisite to the removal of the wheel. This operation is illustrated by FIG. XIII. First, one or the other retainer nut a is removed. Then front axle b is withdrawn from the wheel hub and wheel and tire c merely drop out from between fork end bracket d.

The solution to this problem is illustrated by the adaptive front fork housing of FIG. XV. Two front fork retainer bolts 30 screw into the housing 3 by way of the aperture in the closed fork end bracket 1*a* thereby securing the fork end bracket to the housing.

FIG. XIVa illustrates the open-ended rear bracket which is the one existant arrangement for the bicycle. No more needs to be said about the adaptability of this design.

FIG. XIVb is the closed-end design used by most motorcycles, mini-bikes, and mopeds. As with the situation arising from utilization of the closed-end front fork bracket, the rear axle must be removed in order to remove the wheel. Turning to FIG. XIVc, this operation will be fully described. First, retaining nut a is removed from axle b. Either the rear wheel is then pushed forward to slacken the chain around the rear drive sprocket or, alas, the chain must be separated. At any rate, the chain is removed from the rear drive sprocket, axle b is withdrawn and the wheel drops out.

FIG. XVI represents the response to this situation. The rear axle 27 is removable; it is held in place within the rear drive hub 26 by the two bearing retainer cups 27*b*. By utilizing an axle which has an affixed retainer cup 27*d* at one end which is of a diameter that will permit passage through the aperture in the rear fork end bracket 2*a*, the axle can be inserted through the one fork end bracket, through the rear drive hub, threaded through a bearing retainer cup 27*b* then through the aperture in the other fork end bracket. Two rear fork retainer nuts 30*a* then secure the rear forks to the assembly. The motive vehicle drive chain is placed around rear drive sprocket 7, re-linked, and the unit is ready for operation.

Regarding the rear drive sprocket for motor powered vehicles, one notices a few differences in comparison to that of the bicycle. Firstly, that the sprocket is mounted on the left side of the vehicle in most cases. This presents no design problem to the invention—all that is necessary is a mirror-image of the rear fork housing and drive assembly. Secondly, it is a solitary sprocket and it is affixed, usually by bolts to a rather substantial rear wheel hub assembly. This rear wheel hub assembly comprises a hub clutch mechanism, upon which the sprocket is directly attached, in combination with a drum or disc brake. Consider FIG. XVII. Part 31 is such a hub clutch mechanism. Its purpose as with all hub clutch mechanisms on all two-wheeled motive vehicles is to permit the rear hub to spin free when the rear drive sprocket is motionless—allowing for coasting of the vehicle. It is a necessary feature and a no less necessary feature on the invention as a gradual de-acceleration of the drive machinery would be desirable after cessation of rotation of the drive sprocket. Hub clutch mechanism 31 is threaded onto the rear drive hub 26; the rear drive sprocket 7 is then affixed to the rear hub clutch 31, the rear axle 27 passing through and not in contact with the aperture in the center of sprocket 7. A spacer 33 and a rear fork retainer nut complete the assembly. The rear hub clutch 31 would be adapted to utilize the specific rear drive sprocket of a specific type and brand of motor-powered vehicle. Usually, this rear sprocket is attached to the hub clutch by four or more retainer bolts as with retainer bolts 32 in the figure. The proposed user of the invention would either remove the existing sprocket from the wheel of his motive vehicle and attach it to the adaptive hub clutch mechanism of the invention, or, as a time-saving measure, purchase a duplicate and affix it "permanently" to the invention. Likewise with the owner of a bicycle, although attaching the sprocket means only threading the sprocket cluster onto the rear drive hub—the hub clutch mechanism is built into the cluster.

The invention described, therefore, renders practical and uncomplicated, the concept of an aquatic craft powered by an already existing attachable power source.

I claim:

1. An aquatic device attachable to and detachable from a tandem-wheeled vehicle with its wheels removed, the aquatic device comprising:

at least one hull;

a front fork housing and steerage swivel assembly;

said swivel assembly affixing to and supporting the front fork end bracket of the vehicle;

said swivel assembly being of swivel configuration and motivating a rudder through motivation of the vehicle's handlebars;

a rear axle drive assembly;

said assembly being comprised of a drive axle rotatable through a supporting structure which affixes to the rear fork end bracket of the vehicle;

said drive axle being motivated by an attached chain drive sprocket of a design derivative of that in use by the vehicle before removal of the vehicle's wheels;

said drive axle, in turn, motivating an aquatic propulsive assembly culminating in a propeller.

2. The aquatic propulsive assembly of claim 1 which is further characterized by consisting of:

a second chain sprocket centrally located on the rear drive axle and affixed to this axle, therefore rotating with rotation of the drive axle;

said chain sprocket, in turn, motivating an encircling drive chain;

said drive chain, in turn, motivating a third chain sprocket which it encircles at the opposite extremity to the abovementioned chain sprocket, this third chain sprocket being affixed to one of a pair of bevel gears;

said bevel gear affixed to the chain sprocket motivating a partner bevel gear which is affixed to and therefore rotates a propeller shaft.

3. The front fork housing and steerage swivel assembly of claim 1 which is further characterized as being slidably mounted on a track to permit accommodation of varying wheelbases of tandem-wheeled vehicles.

4. The invention according to claim 1 which utilizes a bicycle as its power source;

the front and rear fork end brackets of said bicycle being held fast to the front and rear fork end bracket housings of the invention by quick-release hub mechanisms.

5. The invention according to claim 1 which utilizes a motor-powered tandem-wheeled vehicle as its power source.

6. The front fork housing and steerage swivel assembly referenced in claim 1 which is further characterized as consisting of a swivel having two lines attached to the rotating member of the swivel;

said lines crossing aft of the swivel and proceeding to attachment to the rudder.

* * * * *